US008171872B1

(12) United States Patent
Jenkins

(10) Patent No.: US 8,171,872 B1
(45) Date of Patent: May 8, 2012

(54) INTERACTIVE SUBMERGIBLE TOW CRAFT

(76) Inventor: Robert Jenkins, Hobe Sound, FL (US)

( * ) Notice: Subject to any disclaimer, the term of this patent is extended or adjusted under 35 U.S.C. 154(b) by 393 days.

(21) Appl. No.: 12/536,236

(22) Filed: Aug. 5, 2009

(51) Int. Cl.
*B63C 11/46* (2006.01)

(52) U.S. Cl. ..... 114/315

(58) Field of Classification Search ..... 114/315, 114/162, 253
See application file for complete search history.

(56) References Cited

U.S. PATENT DOCUMENTS

| | | | | |
|---|---|---|---|---|
| 2,843,860 | A | 7/1958 | Grootveld | |
| 2,948,251 | A | 8/1960 | Replogle | |
| 3,130,693 | A * | 4/1964 | Shell | 108/108 |
| 3,257,982 | A * | 6/1966 | Meldrum | 114/315 |
| 3,638,598 | A | 2/1972 | Vlad | |
| 3,791,223 | A * | 2/1974 | Treichel et al. | 74/493 |
| 4,149,483 | A | 4/1979 | Scott, Jr. | |
| 4,624,207 | A | 11/1986 | King | |
| 5,134,955 | A | 8/1992 | Manfield | |
| 5,178,090 | A | 1/1993 | Carter | |
| 6,561,116 | B2 | 5/2003 | Linjawi | |
| 6,575,114 | B2 | 6/2003 | Sandler et al. | |
| 7,004,099 | B2 * | 2/2006 | Iijima et al. | 114/315 |

FOREIGN PATENT DOCUMENTS

| | | |
|---|---|---|
| CA | 757954 | 2/1967 |
| EP | 0.246.853 | 11/1987 |
| GB | 1.144.305 | 11/1969 |

* cited by examiner

*Primary Examiner* — Stephen Avila
(74) *Attorney, Agent, or Firm* — Michael I. Kroll

(57) ABSTRACT

An Interactive Submergible Tow Craft pulled by a powered vessel such as water skies and tubes for tubing. A user seated in the craft has control over a pair of rudders which rotate either upward or downward causing the craft to submerge in water or breach the craft while being pulled through the water. The craft may be broken down into smaller parts for customization, maintenance or easy transport.

17 Claims, 12 Drawing Sheets

INTERACTIVE SUBMERGIBLE TOW CRAFT

BACKGROUND OF THE INVENTION

1. Field of the Invention

The present invention relates generally to towed watercraft and, more specifically, to a small seated craft that is non-powered and pulled by a powered vessel much like water skies and tubes used for tubing. While being towed, a user seated on the craft has control over a pair of forward rudders, that when actuated to rotate either upward or downward, act as an elevon to selectively submerge or breach the craft while being pulled through the water. Forming the device are two primary portions joined by a key piece, the front portion consists of the port and starboard forward rudders while the back portion facilitates the user's seat, foot rests, rudder controls and back rest. The present invention is furthermore able to be broken down and customizable to adjust the seating, sensitivity of rudder control, and positioning of foot rests. Additionally the present invention features a seat with a back-rest at its back end to carry a rider on the device while being towed meanwhile situating the rider local to his/her rudder controls.

2. Description of the Prior Art

There are other towed watercraft devices designed for selectively submerging and breaching the waters surface. Typical of these is U.S. Pat. No. 2,843,860 issued to Grootveld on Jul. 22, 1958.

Another patent was issued to Replogle on Aug. 9, 1960 as U.S. Pat. No. 2,948,251. Yet another U.S. Pat. No. 3,638,598 was issued to Vlad on Feb. 1, 1972 and still yet another was issued on Apr. 17, 1979 to Scott Jr. as U.S. Pat. No. 4,149,483.

Another patent was issued to King on Nov. 25, 1986 as U.S. Pat. No. 4,624,207. Yet another U.S. Pat. No. 5,134,955 was issued to Manfield on Aug. 4, 1992. Another was issued to Carter on Jan. 12, 1993 as U.S. Pat. No. 5,178,090 and still yet another was issued on May 13, 2003 to Linjawi as U.S. Pat. No. 6,561,116.

Another patent was issued to Sandler et al. on Jun. 10, 2003 as U.S. Pat. No. 6,575,114. Yet another Canadian Patent No. CA757954 was issued to Karoly on May 2, 1967. Another was issued to Milne-Redhead on Nov. 14, 1966 as British Patent No. GB 1144305 and still yet another was issued on May 18, 1987 to Bloxham as European Patent No. EP0246853.

U.S. Pat. No. 2,843,860

Inventor: Richard L. Grootveld

Issued: Jul. 22, 1958

An underwater sled comprising a frame formed of a pair of parallel tubular side members closed at each end, a tubular runner extending downwardly from each side member, connecting bars secured between said side members, a diving fin rockabilly carried by the forward end of said frame between said parallel tubular side members, banking fins carried by the forward end of said frame on opposite sides exteriorly of said side members, a transversely extending shaft forming a common pivot for said diving fin and said banking fins, a rock lever, said lever for substantially universal rocking movement, means connecting said lever with said diving fin whereby forward and backward movement of said lever selectively tilts said diving fin downwardly and upwardly, additional means connecting said lever with banking fins, whereby lateral tilting of said lever rocks both banking fins, one banking fin rocking reversely from the other banking fin, an inverted U shaped leg confining member at the rear of the frame, means adjustably securing said leg confining member to said frame, and a pair of leveling fins fixed to opposite sides of the rear ends of said members.

U.S. Pat. No. 2,948,251

Inventor: Edward H. Replogle

Issued: Aug. 9, 1960

An under water towed diving plane comprising a frame member having an upwardly curved forward portion, a wing mounted on said forward portion for rotation about a lateral axis for depth control purposes, and an underarm occupant retention bar disposed substantially parallel to said lateral axis and arranged above the rearward end of said frame member.

U.S. Pat. No. 3,638,598

Inventor: John J. Vlad

Issued: Feb. 1, 1972

A water vehicle on which a rider may be towed by a boat or the like either on or beneath the surface of the water. The water vehicle comprises a substantially U-shaped frame member having the arm members of a pair of plane or planer members rotatable mounted to each leg thereof and including a pair of handles carried by each arm member to permit the rider of the water vehicle to independently rotate the planes relative to one another and to the frame member to thereby control the motion of the water vehicle while it is being towed by the boat. The ends of each leg of the U-shaped frame member are curved outwardly therefrom and are adapted to cooperate with the arm handles to permit the water vehicle to be mounted to the sides of a boat or the like whereby the water vehicle functions as a ladder to permit entry into the boat.

U.S. Pat. No. 4,149,483

Inventor: John W. Scott

Issued: Apr. 17, 1979

A device to be towed through the water by a boat and which in turn is adapted to tow a person through the water, the body of the device having a constant buoyancy and being equipped with steering means whereby it can be maintained on the surface of the water while being towed, can be submerged while towing a person with scuba gear, and which can be maneuvered under water to partially or completely roll the device and its user.

U.S. Pat. No. 4,624,207

Inventor: John D. King

Issued: Nov. 25, 1986

An underwater diving plane towed by a boat and ridden by a diver includes a longitudinal diver support member which supports the diver in the prone position, a lateral wing support member with contoured wings attached at the ends thereof and evenly spaced from the center thereof, a pivotal attachment fitting for attaching the front end of the diver support member to the center of the lateral wing support member and one or more control arms that are rigidly attached to the lateral wing support member and that extend therefrom below the diver support member so as to be within easy reach of the diver carried thereon in the prone position, whereby the diver may rotate the lateral wing support member within the pivotal attachment fitting on its lateral axis with respect to the diver support member, thereby controlling the diving angle of the diving plane as it is towed through the water by a tow line attached to the pivotal fitting.

U.S. Pat. No. 5,134,955

Inventor: Harold D. Manfield

Issued: Aug. 4, 1992

A submergible, two-passenger dive sled includes a foldable sled frame being adjustable in length, a break-away tow hook for interconnection within the tow line of a power boat, an adjustably foldable deflecting screen having a preferred position for maintaining the elevation of the sled at a preferred depth, forward most situated diver-controlled pivotable ailerons for adjusting and manipulating the axial stability and selected depth of the sled, and a break away tail piece feature for added safety. The dive sled is structured to have a positive buoyancy at its front end relative to its back end. The sled may be segmented into interconnected parts and may include selectively removable components for convenient storage and shipment. A number of electric lines are provided for provided power to lights optionally mounted on the sled and for allowing communication by an electric signal switch and an optional voice communicator. A series of diver-enclosing anti-shark shields may optionally be provided.

U.S. Pat. No. 5,178,090

Inventor: Brian M. Carter

Issued: Jan. 12, 1993

An underwater diving plane has a main frame forming an isosceles triangle, having a base part, two side legs of equal length and an apex; a detachable transverse axle which is pivotally connected to the main frame, having two ends and two main planes each fixedly attached to the axle; a foreplane attached to the frame proximal to the apex; and a tow force transition cable to allow the planes stable planing action.

U.S. Pat. No. 6,561,116

Inventor: Kareem O. Linjawi

Issued: May 13, 2003

There is disclosed an improved sub-aqua device suitable for towing a person through the water. Specifically there is disclosed a sub-aqua device including: a support member; a pair of maneuvering planes for maneuvering the device, each defining an elevation plane; and a means for controlling each maneuvering plane including a handle, each handle extending in a plane coincident with the respective elevation plane.

U.S. Pat. No. 6,575,114

Inventor: Richard H. Sandler

Issued: Jun. 10, 2003

Device for use in human controlled water surface and subsurface travel includes a towbar having first and second end portions. The device includes a first control member that is rotatably coupled to the towbar adjacent to the first end portion and the first control member has a first control surface and a second control surface opposite the first control surface. The device further includes a second control member rotatably coupled to the towbar adjacent to the second end portion and spaced from the first control member, and the second control member has a third control surface and a fourth control surface opposite the third control surface. The device further includes first and second grips spaced apart and fixed to the towbar between the first and second control members so that rotation of the first and second grips about a longitudinal axis of the towbar enables the first and second control members to be independently rotated about the longitudinal axis of the towbar.

Canadian Patent Number CA757954

Inventor: Nemere Karoly

Issued: May, 2, 1967

This invention relates to swimming devices and particularly to a light weight device which will float and have a minimum resistance when pushed forward in the water and have a maximum resistance when pulled backwards, sufficient to enable the user to move rapidly in a forward direction.

U.K. Patent Number GB 1144305

Inventor: Maurice R. Milne-Redhead

Issued: Mar. 5, 1966

An aquatic propulsion device comprises a longitudinally arranged spine or body 1 on or over which the person using the device is intended to lie, the spinal body carrying at its forward end a handlebar 2 or other part intended to be grasped by the. hand and at its rear end, a horizontally arranged propulsion vane or flipper 11 which is adapted to be given a flexing or pivotable movement in a vertical plane by means 16 operable by the feet. The handlebar is fitted with stub vanes or elevators 4 which can be angularly displaced in control device in a pitching plane by twist grip controls 3, grasped by the hands of the user. The pedals 16 are alternately depressed by the feet of the user to impart angular movement to the vane or flippers through the medium of a multi-flow crank shaft. Horizontal vanes 13 are provided for preventing or minimizing purposing and a vertically mounted directional vane or rudder 6 adjustable by the user to control lateral drift.

European Patent Application Number EP0246853

Inventor: Marshall Ernest Albert Bloxham

Issued: May 18, 1987

A sledge on which a diver can be towed underwater by a vessel comprises a sledge wing (1), on which the diver lies, holding himself in place by gripping a thigh grip post (26). Two towing lines (4,5) are attached at one end to the sledge just in front of the lateral centre of pressure and the centre of gravity of the sledge, and at the other end to a towing foil (6), from which a towing line (7) leads to the towing vessel. The diver can maneuver the sledge by moving control rods (17,18) which move elevons (21,22) at the rear of the sledge. Transparent upper and lower screens (8,10) deflect the water flow past the sledge and, in combination with a viewing section (9) through the sledge wing (1), allow the diver to see clearly forwards and downwards in a natural sweep of the eyes for optimum visibility.

While these submersible watercraft may be suitable for the purposes for which they were designed, they would not be as suitable for the purposes of the present invention, as hereinafter described.

SUMMARY OF THE PRESENT INVENTION

A primary object of the present invention is to provide a towed watercraft having a seat and backrest capable of selectively submerging and breaching the waters surface while being pulled by a vessel through a body of water.

Another object of the present invention is to provide a towed watercraft having a seat and backrest with a plurality of controls located nearby said seat, to control a set of rudders that act as elevons.

Yet another object of the present invention is to provide a towed watercraft having a several part construction making the device collapsible and easily transported from vessel to vessel.

Still yet another object of the present invention is to provide a towed watercraft having a seat and backrest that has an adjustable foot rest location.

Another object of the present invention is to provide a towed watercraft having a seat and backrest having both a port and starboard rudders shaped much like a wings in order to divert water either upward or downward to produce a diving or ascending forward displacement.

Yet another object of the present invention is to provide watercraft having a seat and backrest that has a plurality of rudders that may be operated individually in order to control the pitch and roll of the craft while traveling through a fluid medium.

Still yet another object of the present invention is to provide watercraft having a seat and backrest that is adjustable in length and size in order to accommodate differently sized people comfortably.

Still yet another object of the present invention is to provide watercraft having a seat and backrest that is capable of being broken down to many individual parts and is customizable in its seating location, foot rest location, and control sensitivity.

Additional objects of the present invention will appear as the description proceeds.

The present invention overcomes the shortcomings of the prior art by providing watercraft having a seat and backrest capable of selectively being controlled by a port and starboard rudder set, having individual controls for said set so that the user may manipulate the craft to dive, ascend, breach, turn, pitch and roll based on the directed orientation of said rudders while the craft is being pulled through a fluid medium. Additionally the present invention is adjustable in size and easily broken down, so that users of any size may easily transport the device from location to location.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
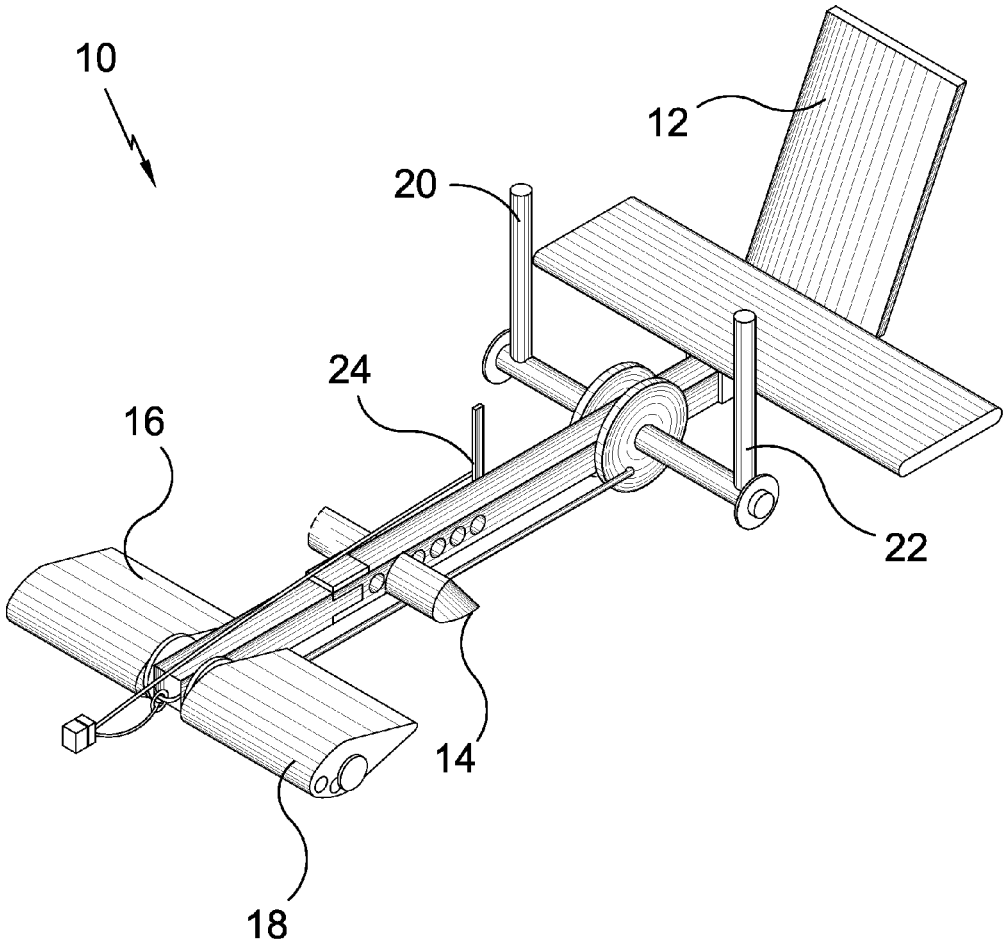
FIG. 1 is a perspective view of the present invention.

Turning now descriptively to the drawings, in which similar reference characters denote similar elements throughout the several views, the figures illustrate the Interactive Submergible Tow Craft of the present invention. With regard to the reference numerals used, the following numbering is used throughout the various drawing figures.

| | |
|---|---|
| 10 | Interactive Submergible Tow Craft of the present invention |
| 12 | seat |
| 14 | footrest |
| 16 | forward starboard side rudder |
| 18 | forward port side rudder |
| 20 | starboard side rudder control |
| 22 | port side rudder control |
| 24 | quick release |
| 26 | adjusted seat |
| 28 | control rod |
| 30 | push rod |
| 32 | back rest |
| 34 | tow line |
| 36 | vessel |
| 38 | rudder control cam |
| 40 | rudder cam |
| 42 | neutral fluid flow |
| 44 | downward fluid flow |
| 46 | upward fluid flow |
| 48 | upward force |
| 50 | downward force |
| 52 | roll |
| 54 | forward portion |
| 56 | rearward portion |
| 58 | junction lock |

-continued

| | |
|---|---|
| 60 | foot rest apertures |
| 62 | setting apertures |
| 64 | key way |
| 66 | foot rest bars |
| 68 | receiving apertures |

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention 10. Shown is the tow sub of the present invention 10 comprising a seated device utilized by being towed by another vessel. The present invention provides two rudders 16, 18 attached to individualized controls 20, 22 that allow the user to actuate each rudder 16, 18 to either plane or dive the tow sub while being towed.

Figure 2:
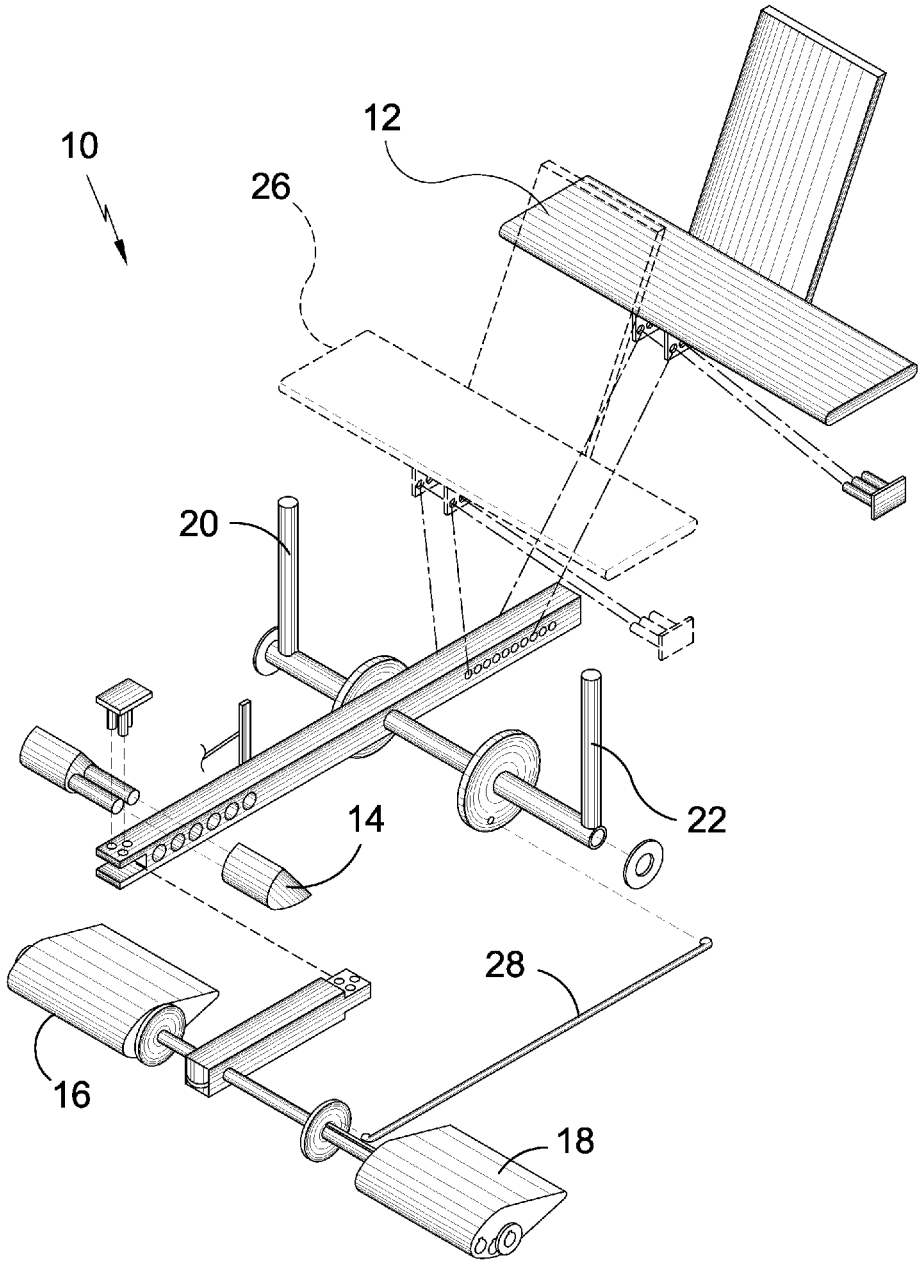
FIG. 2 is an exploded perspective view of the present invention.

FIG. 2 is an exploded perspective view of the present invention 10. Shown is the present invention 10 exploded into its individual components revealing how the present invention may be broken down into many smaller parts for easily transporting from location to location and for more precise servicing and customization of individual parts.

Figure 3:
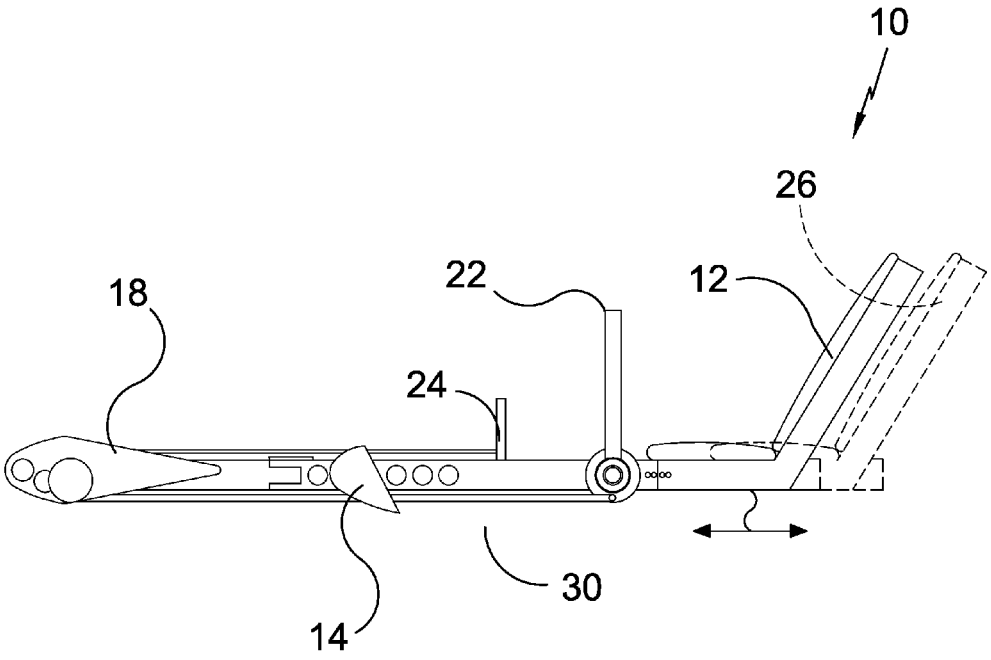
FIG. 3 is a side view of the present invention.

FIG. 3 is a side view of the present invention 10. Shown is a side view of the present invention 10 depicting each forward rudder 18 having its own individual control 22 for manipulating its angular configuration. Manipulation of the rudder 18 is accomplished utilizing a push rod 30 connection between the two that delivers control utilizing a rotational cam based displacement. Also shown is the adjustable seat 26.

Figure 4:
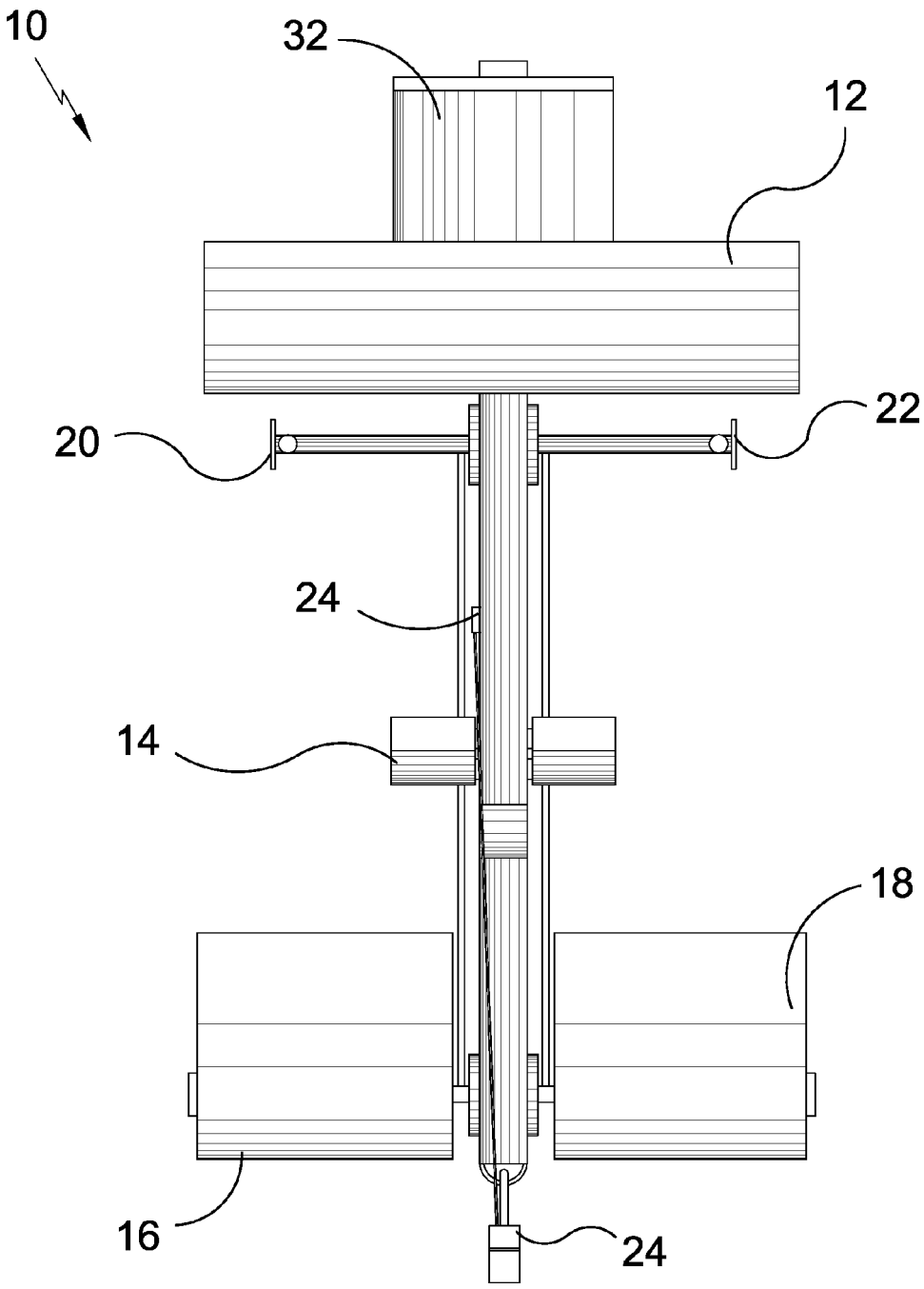
FIG. 4 is a top view of the present invention.

FIG. 4 is a top view of the present invention 10. Shown is a top view of the present invention 10 depicting each forward rudder 16, 18 having its own individual control 20, 22 for manipulating its angular configuration. Placed behind said rudder controls 20, 22 is a seat with a backrest 32 whereby the user sits and operates the device comfortably while being towed in seated position. Additionally the user of the present invention 10 utilizes said controls 20, 22 in order to dive the device under water or to plain it off up to the surface.

Figure 5:
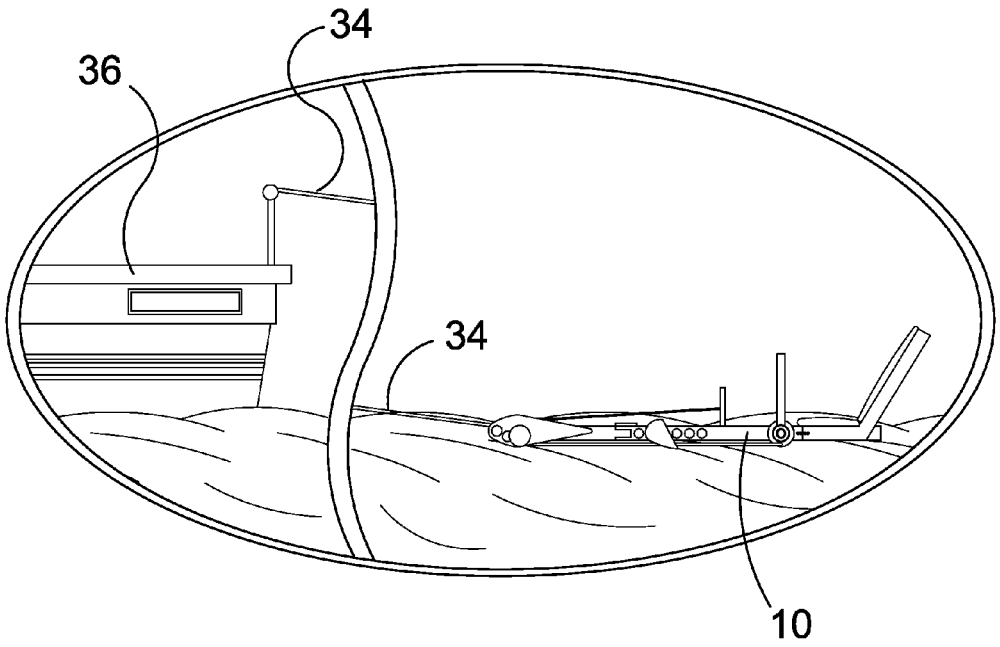
FIG. 5 is a side view of the present invention.

FIG. 5 is a side view of the present invention 10. Shown is a side view of the present invention 10 depicting a tow line 34 as a means for attaching the present invention to a vessel 36.

Figure 6:
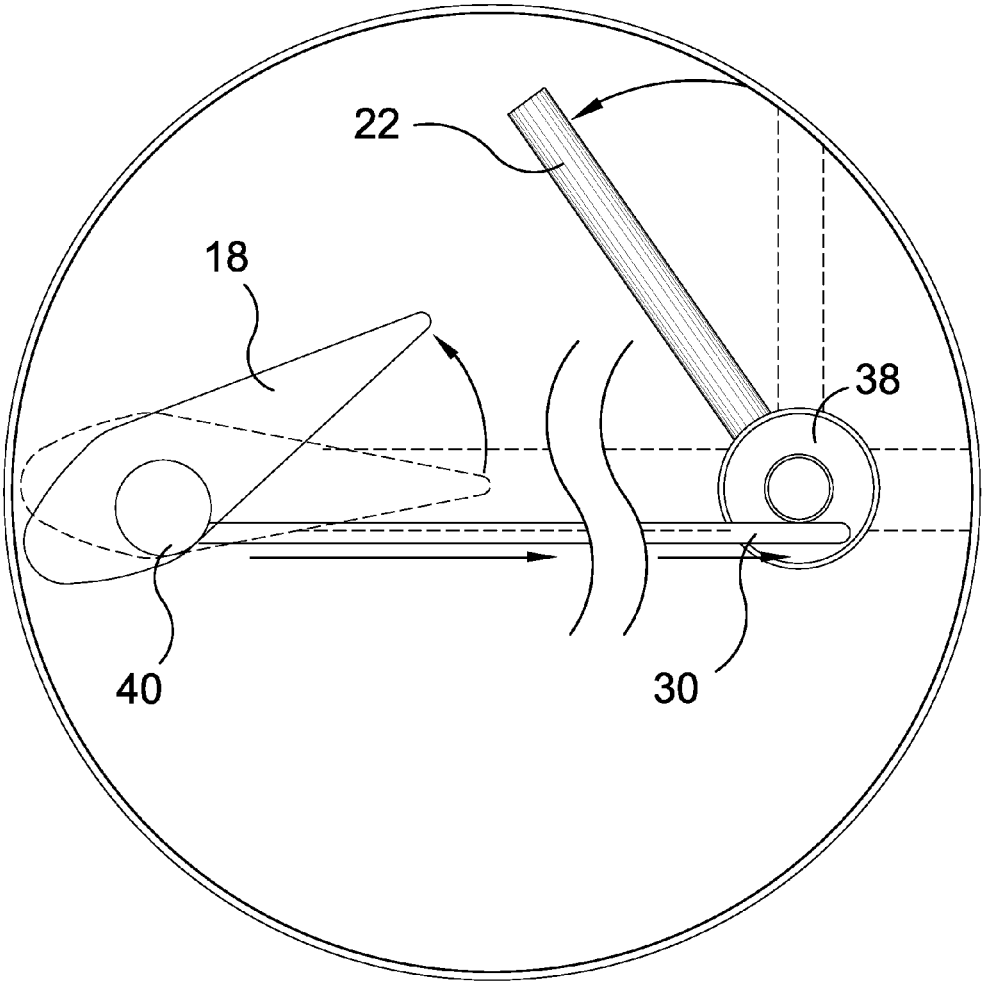
FIG. 6 is a side detailed view of the present invention.

FIG. 6 is a side detailed view of the present invention. Shown is a side detailed view of the present invention showing how a forward rotational displacement of the rudder control 22 on a pivoting cam 38 system will induce a counter clockwise rotation in the rudder 38 caused by a pushing action by the push rod 30 on the lower portion of the cam 40 connected to the rudder 18.

Figure 7:
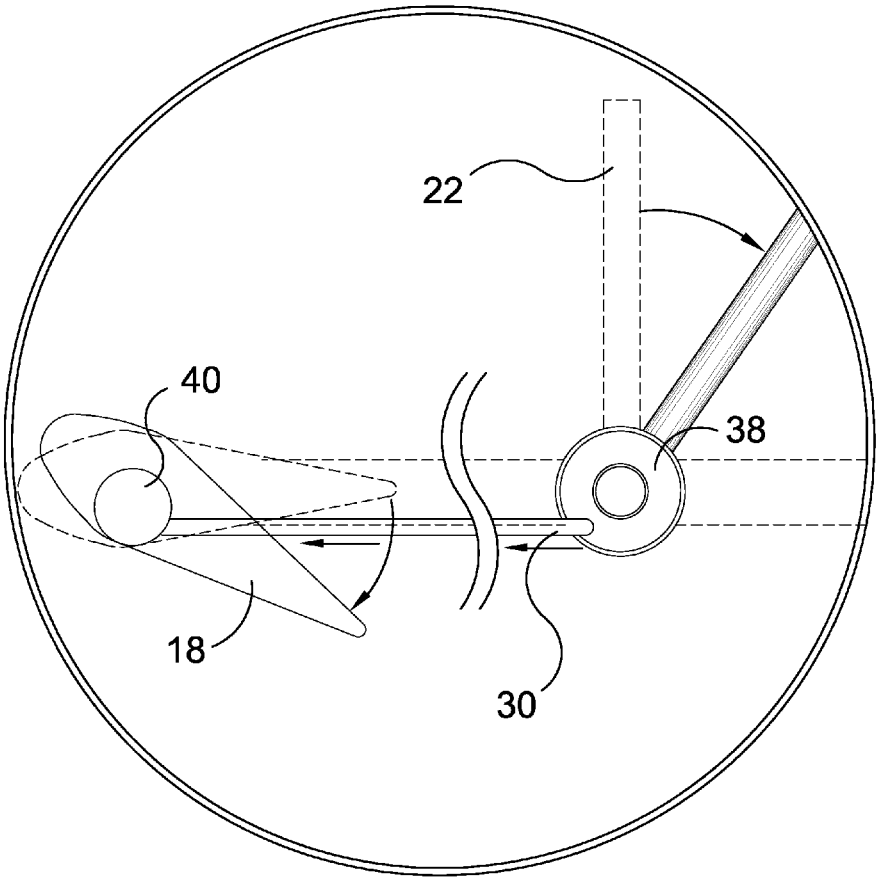
FIG. 7 is a side detailed view of the present invention.

FIG. 7 is a side detailed view of the present invention. Shown is a side detailed view of the present invention showing how a backward rotational displacement of the rudder control 22 on a pivoting cam 38 system will induce a clockwise rotation in the rudder 18 caused by a pulling action by the push rod 30 on the lower portion of the cam 40 connected to the rudder 18.

Figure 8:
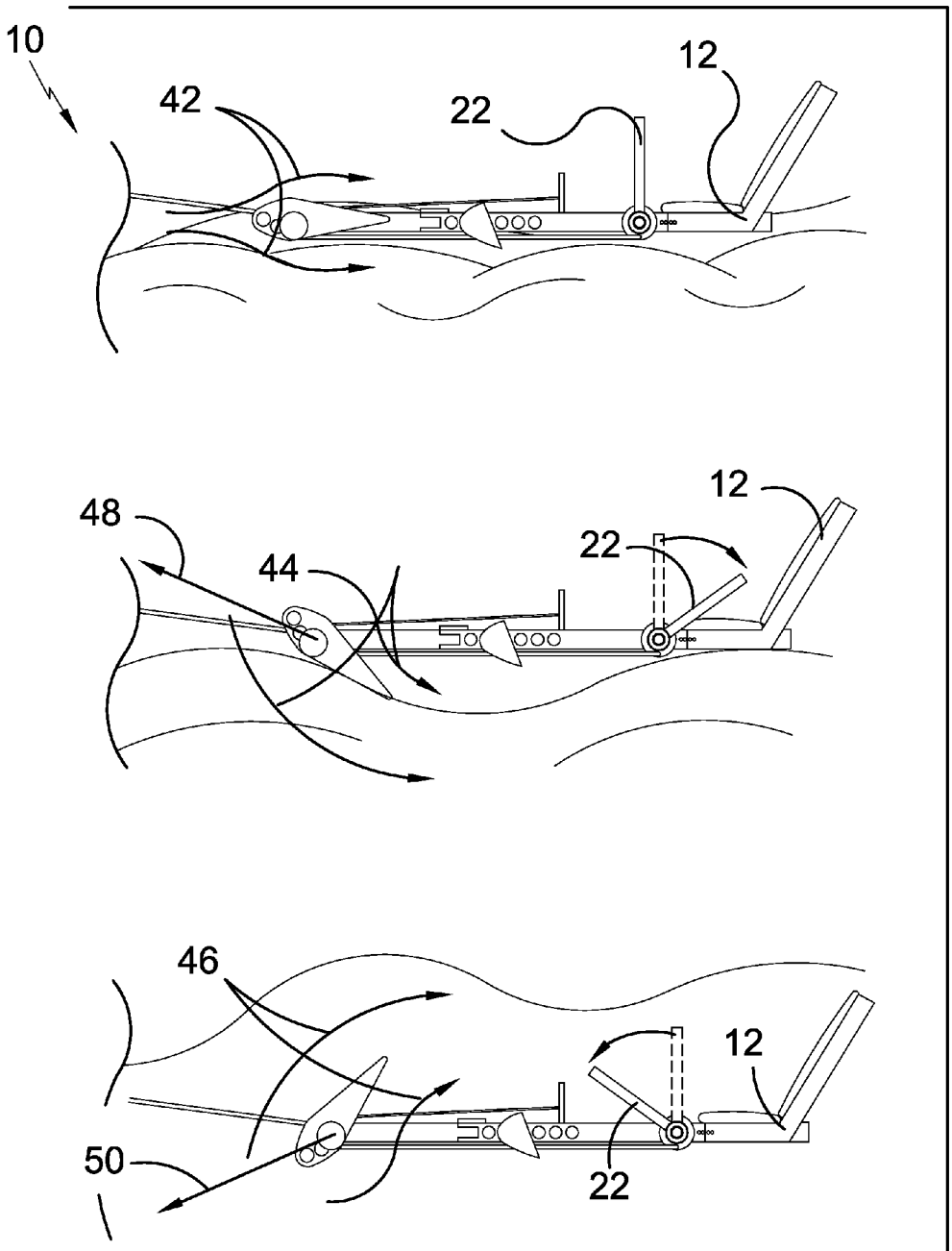
FIG. 8 is a side illustrated view of the present invention.

FIG. 8 is a side illustrated view of the present invention 10. Shown is a side illustrated view of the present invention 10 in use being towed via a tow line from the rear of a traveling vessel. When the controls 22 are moved forward fluid is directed to flow upward 46 from the rudder pushing the device downward 50, when the controls are moved backward fluid is directed to flow downward 44 from the rudder pushing the device upward 48.

Figure 9:
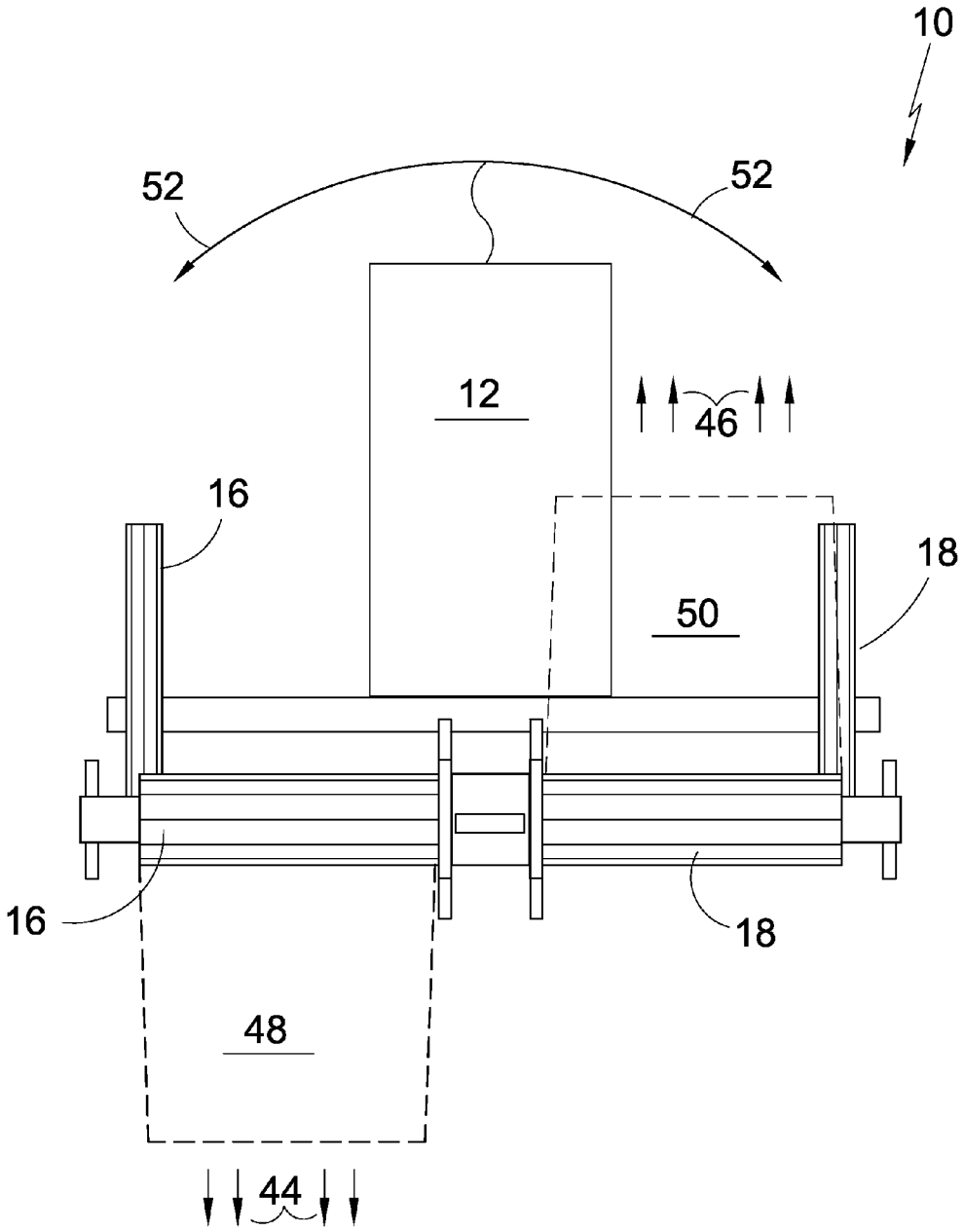
FIG. 9 is a perspective view of opposing controls of the present invention.

FIG. 9 is a perspective view of opposing controls 20, 22 of the present invention 10. Shown is the present invention 10 having two rudders 16, 18 attached to individualized controls 20, 22 that allow the user while being towed to actuate each rudder 16, 18 to help either plain or dive the entire present 10 invention with the user.

Figure 10:
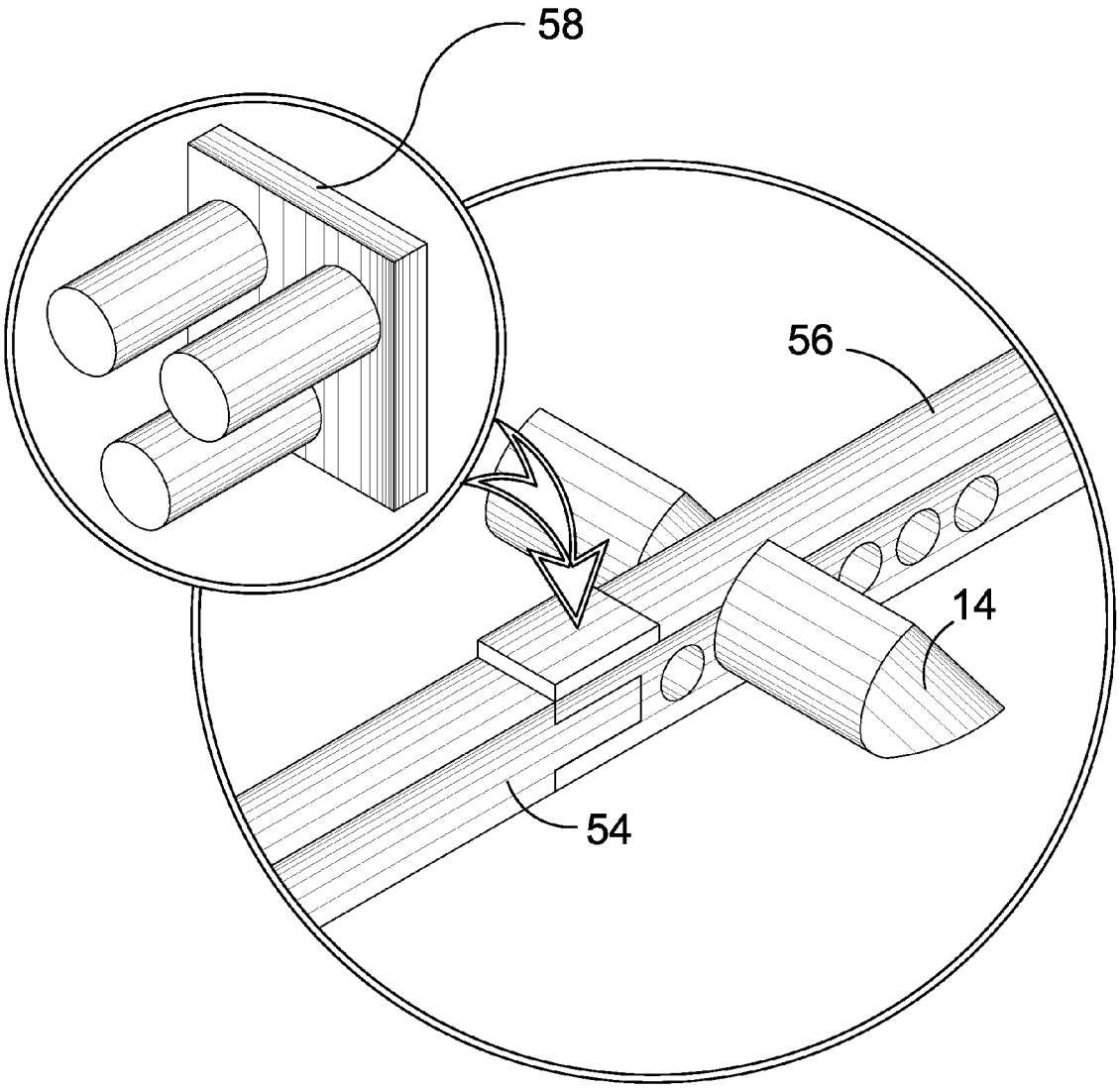
FIG. 10 is a perspective view of the present invention.

FIG. 10 is a perspective view of the present invention. Shown is the present invention having an additional element being a partition that makes the present invention collapsible and easy to transport. The present invention is composed of a forward portion 54 and a back control and rearward portion 56 that is joined by a junction key lock 58. Said respective portions 54, 56 may also be further broken down for even easier transportation and servicing.

Figure 11:
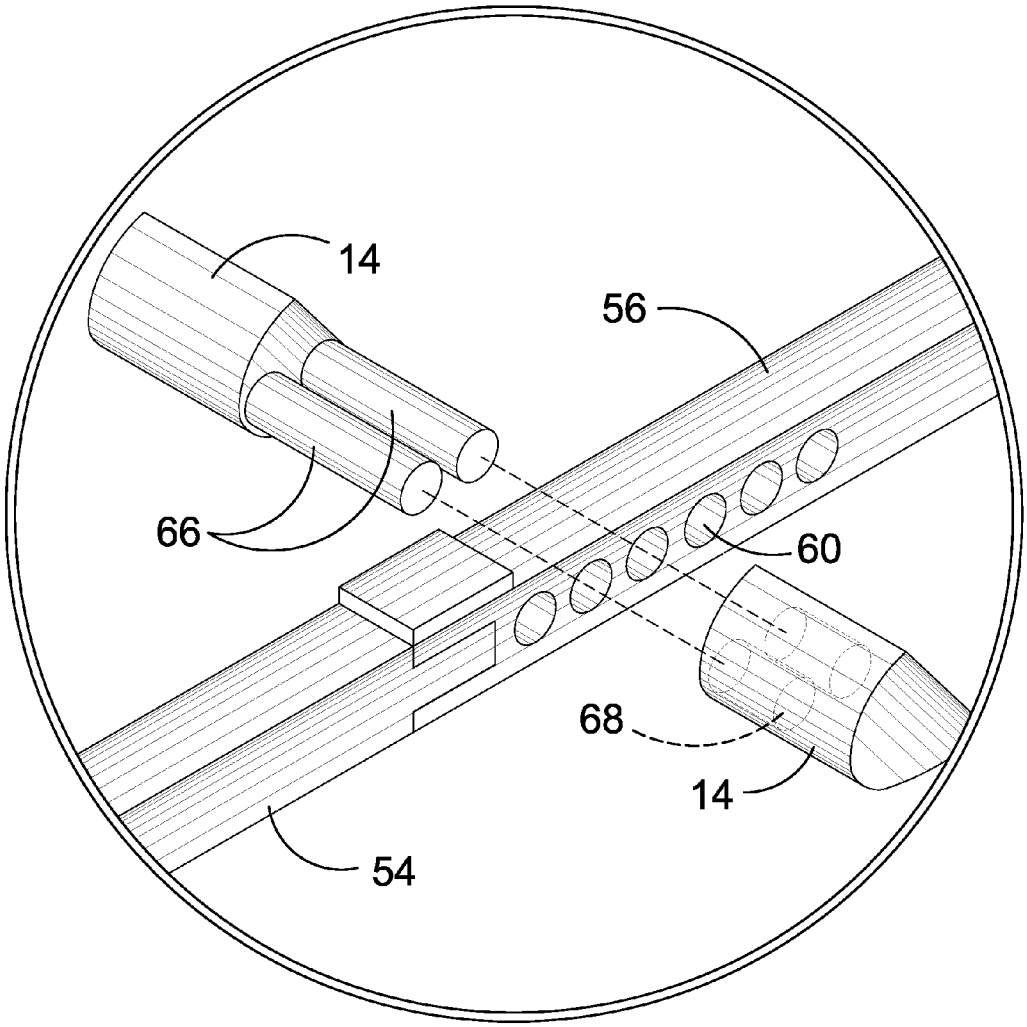
FIG. 11 is a perspective view of the present invention.

FIG. 11 is a perspective view of the present invention. Shown is the present invention having an adjustable foot rest 14 utilizing two foot rest bars 66 fixed and protruding from on said rest that fit through two of the foot rest apertures 60 on the frame that attach through on the other side to a second foot rest 14 having two respective receiving apertures 68.

Figure 12:
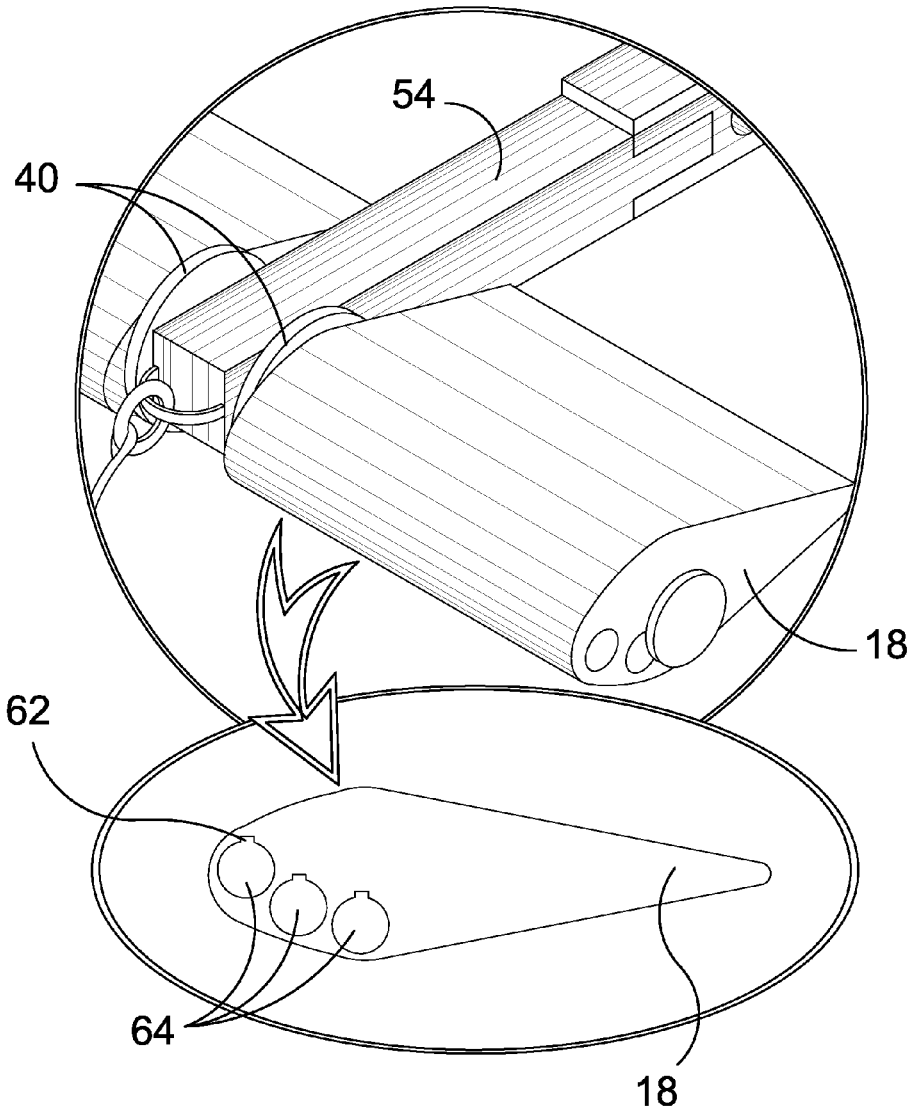
FIG. 12 is a perspective view of the present invention.

FIG. 12 is a perspective view of the present invention. Shown is the present invention having a plurality of setting apertures 64 with key ways 62 for, setting the reactivity of the forward rudder controls. As illustrated the forward port side rudder 18 is set for a lower tow speed with the aperture being below the centerline of the rudder causing the highest control reactivity, switching to the forward most aperture 64 setting gives the rider lower control reactivity allowing for higher tow speeds with the aperture being on the centerline of the rudder.

The invention claimed is:

1. An Interactive Submergible Tow Craft comprising a) a frame;

b) a seat;

c) footrests;

d) a forward starboard side rudder;

e) a forward port side rudder;

f) a control rod;

g) a push rod connection for manipulation of angular configuration of said forward starboard side rudder and forward port side rudder;

h) said push rod uses a rotational cam based displacement for delivery of control between said forward starboard side rudder and said forward port side rudder and said starboard side rudder control and said port side rudder control; and i) said starboard side rudder control and said port side rudder control has a forward rotational displacement on a pivoting system which induces a counter clockwise rotation in said forward starboard side rudder and said forward port side rudder caused by a pushing action by said push rod on the lower portion of said pivoting cam connected to said forward starboard side rudder and forward port side rudder.

2. An Interactive Submergible Tow Craft according to claim 1, wherein said seat is adjustable.

3. An Interactive Submergible Tow Craft according to claim 1, wherein said seat has a back rest.

4. An Interactive Submergible Tow Craft according to claim 1, wherein said starboard side rudder and said forward port side rudder are attached to individualized controls allowing for actuation of said starboard side rudder and forward port side rudder to plain or dive said interactive submergible tow craft.

5. An Interactive Submergible Tow Craft according to claim 4, wherein said individualized controls are starboard side rudder control and port side rudder control.

6. An Interactive Submergible Tow Craft according to claim 1, further comprising a junction key lock joining a front portion, a back control and said seat.

7. An Interactive Submergible Tow Craft according to claim 1, wherein said frame further comprises foot rest apertures for attachment of said footrests.

8. An Interactive Submergible Tow Craft according to claim 7, wherein one of said footrest further comprises foot rest bars.

9. An Interactive Submergible Tow Craft according to claim 7, wherein one of said footrests further comprises receiving apertures to receive said foot rest bars through said foot rest apertures.

10. An Interactive Submergible Tow Craft according to claim 1, wherein said forward starboard side rudder and said forward port side rudder further comprise setting apertures for setting reactivity of said forward starboard side rudder and said forward port side rudder controls.

11. An Interactive Submergible Tow Craft according to claim 10, wherein said setting apertures further comprise key ways.

12. An Interactive Submergible Tow Craft according to claim 1, wherein said starboard side rudder control and said port side rudder control has a backward rotational displacement.

13. An Interactive Submergible Tow Craft according to claim 12, wherein forward movement of said starboard side rudder control and said port side rudder control directs fluid to flow upward from said forward starboard side rudder and forward port side rudder pushing said interactive submergible tow craft downward.

14. An Interactive Submergible Tow Craft according to claim 12, wherein backward movement of said starboard side rudder control and said port side rudder control directs fluid to flow downward from said forward starboard side rudder and forward port side rudder pushing said interactive submergible tow craft upward.

15. An Interactive Submergible Tow Craft according to claim 1, further comprising a quick release lever.

16. An Interactive Submergible Tow Craft according to claim 1, wherein said interactive submergible two craft is connected to a vessel using a tow line.

17. An Interactive Submergible Tow Craft according to claim 1, wherein said interactive submergible tow craft is broken apart into smaller parts for easy transportation, precise servicing and customization of said smaller parts.

* * * * *